US010294721B1

(12) United States Patent
Jafarmadar

(10) Patent No.: US 10,294,721 B1
(45) Date of Patent: May 21, 2019

(54) LADDER FOR NARROW STRUCTURES

(71) Applicant: Hossein Jafarmadar, Dania, FL (US)

(72) Inventor: Hossein Jafarmadar, Dania, FL (US)

( * ) Notice: Subject to any disclaimer, the term of this patent is extended or adjusted under 35 U.S.C. 154(b) by 0 days.

(21) Appl. No.: 15/683,731

(22) Filed: Aug. 22, 2017

Related U.S. Application Data

(60) Provisional application No. 62/506,118, filed on May 15, 2017.

(51) Int. Cl.
*E06C 7/48* (2006.01)
*E06C 1/04* (2006.01)

(52) U.S. Cl.
CPC . *E06C 7/48* (2013.01); *E06C 1/04* (2013.01)

(58) Field of Classification Search
CPC ..... E06C 7/48
See application file for complete search history.

(56) References Cited

U.S. PATENT DOCUMENTS 1,994,369 A * 3/1935 Risser ..... E06C 7/48 182/107
2,127,035 A * 8/1938 Kirlin ..... E06C 7/08 182/107
4,363,378 A * 12/1982 Williams ..... E06C 7/48 182/107
4,469,195 A * 9/1984 Sartain ..... E06C 7/48 182/107
4,995,476 A * 2/1991 Buck ..... E06C 1/34 182/107
5,368,127 A * 11/1994 Phillips ..... A01M 31/02 182/100
6,830,128 B2 * 12/2004 Burgeson ..... A01M 31/02 182/116
2002/0108811 A1 * 8/2002 Ulmschneider ..... E06C 1/34 182/206
2002/0179369 A1 * 12/2002 Wallace ..... E06C 1/34 182/63.1
2004/0055821 A1 * 3/2004 Kruse ..... E06C 7/48 182/107

FOREIGN PATENT DOCUMENTS

DE 3204174 A1 * 8/1983 ..... E06C 1/34
EP 0771931 A1 * 5/1997 ..... E06C 1/34

* cited by examiner

*Primary Examiner* — Alvin C Chin-Shue
(74) *Attorney, Agent, or Firm* — H. John Rizvi; John Rizvi, P.A.

(57) ABSTRACT

Disclosed is a ladder assembly configured for being supported on narrow surfaces. The ladder assembly may include a receiving structure that is configured to receive a narrow structure such as a tree or pole, for safely leaning the ladder assembly against the narrow structure. The assembly may include an arm that is operable between an open and closed position for securing the narrow structure in the receiving structure. The assembly may include an anchor to secure the ladder to a proximal surface that supports the ladder.

1 Claim, 10 Drawing Sheets

LADDER FOR NARROW STRUCTURES

CROSS-REFERENCE TO RELATED APPLICATION

This application claims the benefit of U.S. Provisional Patent Application Ser. No. 62/506,118, filed May 15, 2017, which is incorporated herein in its entirety.

FIELD OF THE INVENTION

The present invention relates generally to ladders, and more particularly to a ladder for being supported on narrow structures such as poles or trees.

BACKGROUND OF THE INVENTION

It is common for individuals to use ladders to climb tall structures. For example, a worker may need to elevate themselves to a window to clean the window or a painter may need to elevate themselves up a wall to paint upper portions of the wall.

Common ladders are extension ladders and step ladders. An extension ladder may include a base and one or two upper sections that slide up and down to allow a user to reach different heights. Examples of extension ladders are telescoping ladders and straight ladders. Telescoping ladders can extend to reach various heights, and straight ladders have only a single section. In use, an extension ladder is usually leaned up against a generally vertical surface that is being climbed. A step ladder may have an A-frame design for being vertically supported without leaning on a vertical surface.

Sometimes it is necessary to climb narrow structures such as trees or poles. For example, a tree trimmer may need to lean a ladder against a tree, or an electrician may need to lean a ladder against an electrical pole. However, current ladder configurations are not configured to be safely leaned against such narrow structures. For example, a common extension ladder may have a width (e.g. a distance between side rails) that is much greater than a diameter of a tree or pole, which may cause the ladder to wobble against the tree or pole while being climbed.

Various patents exist that attempt to solve the above problem. However, the configurations in these patents are either too difficult to use, too difficult and complicated to manufacture, too difficult to store, too limited in their compatibility with variously sized narrow structures, or are too unstable to be leaning against a narrow structure while being climbed.

Accordingly, there exists a need for an improved ladder that is stable while leaning against narrow structures or surfaces.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is a ladder assembly configured for being supported on narrow surfaces, the assembly comprising, a proximal end and a distal end, a first lateral side and a second lateral side, the lateral sides being between the proximal end and the distal end, and at the distal end, a narrow surface receiver, the narrow surface receiver being configured to receive a narrow surface somewhere between the lateral sides.

In another aspect, the assembly further comprises an anchor at the proximal end, the anchor being configured to aid in securing the proximal end to a proximal surface.

In another aspect, the narrow surface receiver includes an arm, the arm configured for being selectively opened to an open configuration for receiving the narrow surface.

In another aspect, the narrow surface receiver includes opposing walls for receiving the narrow surface between the walls, where a distance between the opposing walls is decreasingly tapered toward the proximal end.

In another aspect, the narrow surface receiver includes a contoured surface, the contoured surface being configured to at least somewhat contour to a received narrow surface.

In another aspect, the arm is spring biased to at least one of an open and closed configuration.

In another aspect, the assembly includes a controller to selectively open and close the arm.

In another aspect, the controller includes a string that is long enough to be operated by a user standing on the proximal surface.

In another aspect, the assembly includes one or more string securers for securing the string to the assembly.

In another aspect, the narrow surface receiver includes a strap for strapping the narrow surface receiver to a narrow surface.

In another aspect, the narrow surface includes one or more teeth to maximize frictional force between the narrow surface receiver and a received narrow surface.

In another aspect, the narrow surface is a portion of a vertical object.

In another aspect, the narrow surface is a portion of a vertically standing tree.

In another aspect, the narrow surface is a portion of vertically standing pole.

In another aspect, the ladder assembly includes an extension.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
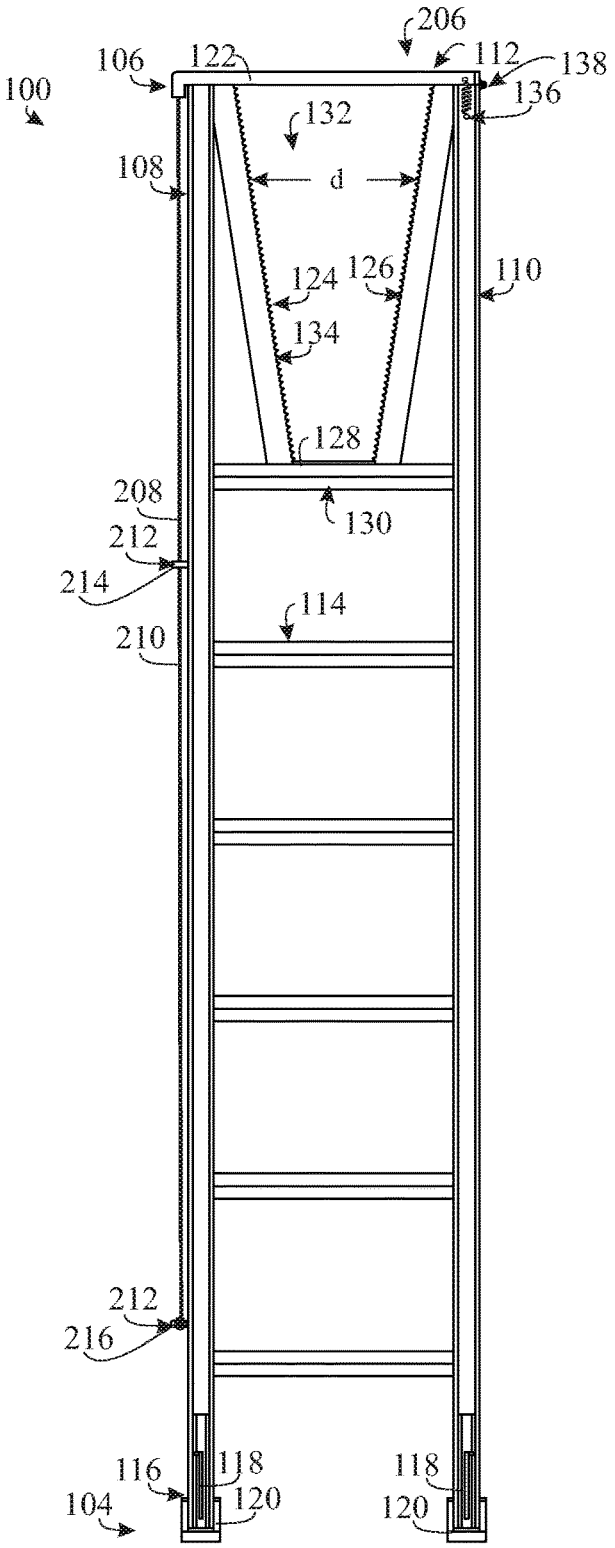
FIG. 1 presents a front view of a ladder assembly, in accordance with aspects of the present disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The illustrations of FIGS. 1-10 show a ladder assembly 100 configured for being supported on narrow surfaces 102 (FIGS. 2-4, 7, 9). The assembly may include a proximal end 104 and a distal end 106, a first lateral side 108 and a second lateral side 110. The lateral sides 108 and 110 may be, or may extend between the proximal end 104 and the distal end 106. At the distal end 106, the ladder assembly 100 may include a narrow surface receiver 112, or an appropriate receiving structure. The narrow surface receiver 112 may be configured to receive a narrow surface 102 somewhere between the lateral sides 108 and 110. For example, the lateral sides 108 and 110 may be side support structures that support a plurality of ladder steps 114, where the steps 114 are perpendicularly received in the lateral sides 108 and 110 as seen in conventional ladders. As non-limiting examples, the narrow surface 102 may be a portion of a vertical object, a portion of a vertically standing tree, or a portion of vertically standing pole.

Figure 5:
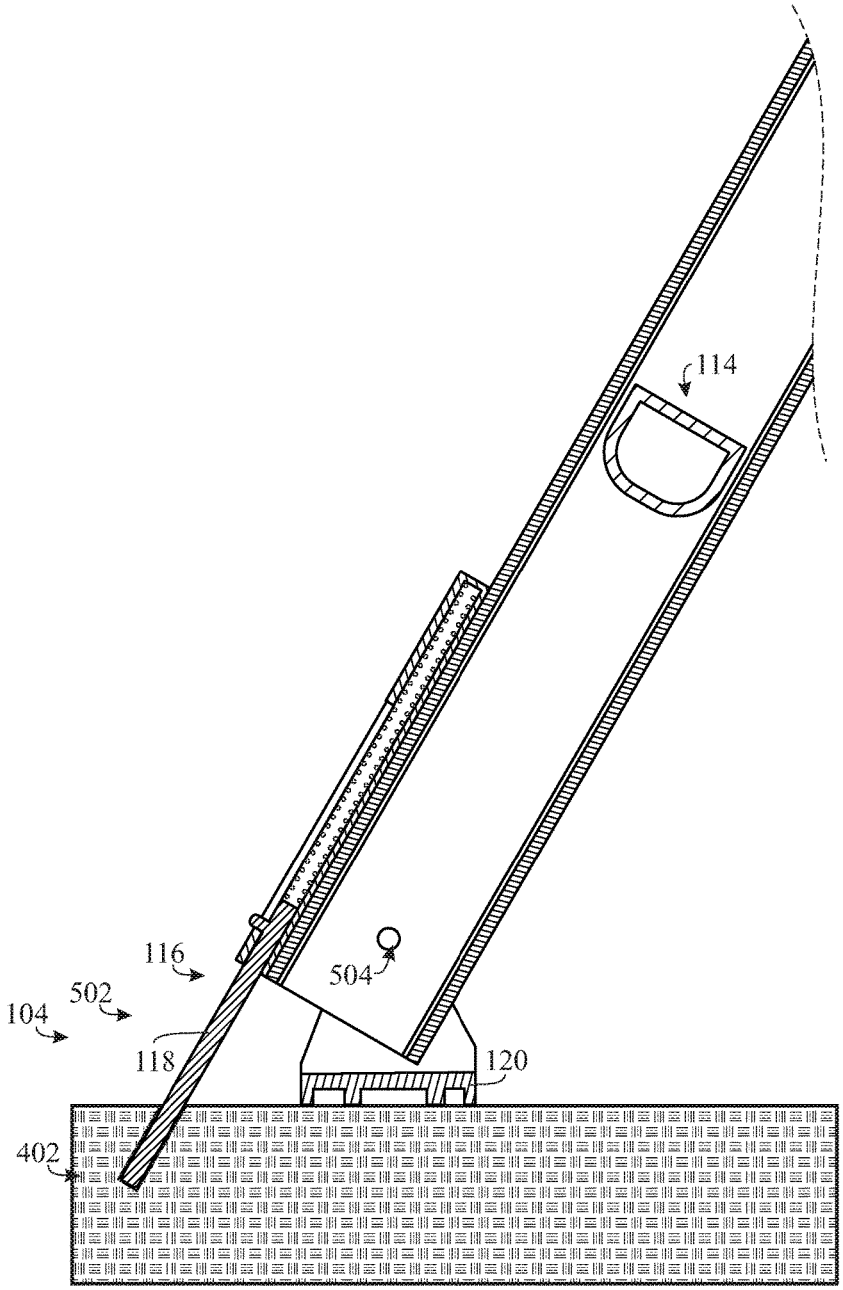
FIG. 5 presents a partial cross sectional view where the section is taken along line 5-5 in FIG. 4, in accordance with aspects of the present disclosure.

The assembly 100 may further include an anchor 116 at the proximal end 104, the anchor 116 being configured to aid in securing the proximal end 104 of the ladder assembly 100 to a proximal surface 402. For example, FIGS. 1 and 5 show the anchor 116 including a pin 118 where the pin 118 is configured to penetrate a proximal surface 402. For example, the pin may be operated between a retracted configuration 202 (FIG. 2) and an extended configuration 502 (FIG. 5) such that the pin penetrates the proximal surface 402 in the extended configuration 502. The proximal surface 402 may be grass or soil, or ground on which the ladder assembly 100 is supported or on which a user stands, for example. The anchor 116 may include two pins 118, each located on opposite lateral sides 108 and 110 at the proximal end 104. As a non-limiting example, the pin 118 may be operated via a latch, and may be locked in either an extended or retracted configuration. As such, the pin 118 may longitudinally extend out proximal end 104 of the ladder for engaging the proximal surface 402 while the ladder assembly 100 is vertically supported on the proximal surface 402.

Figure 9:
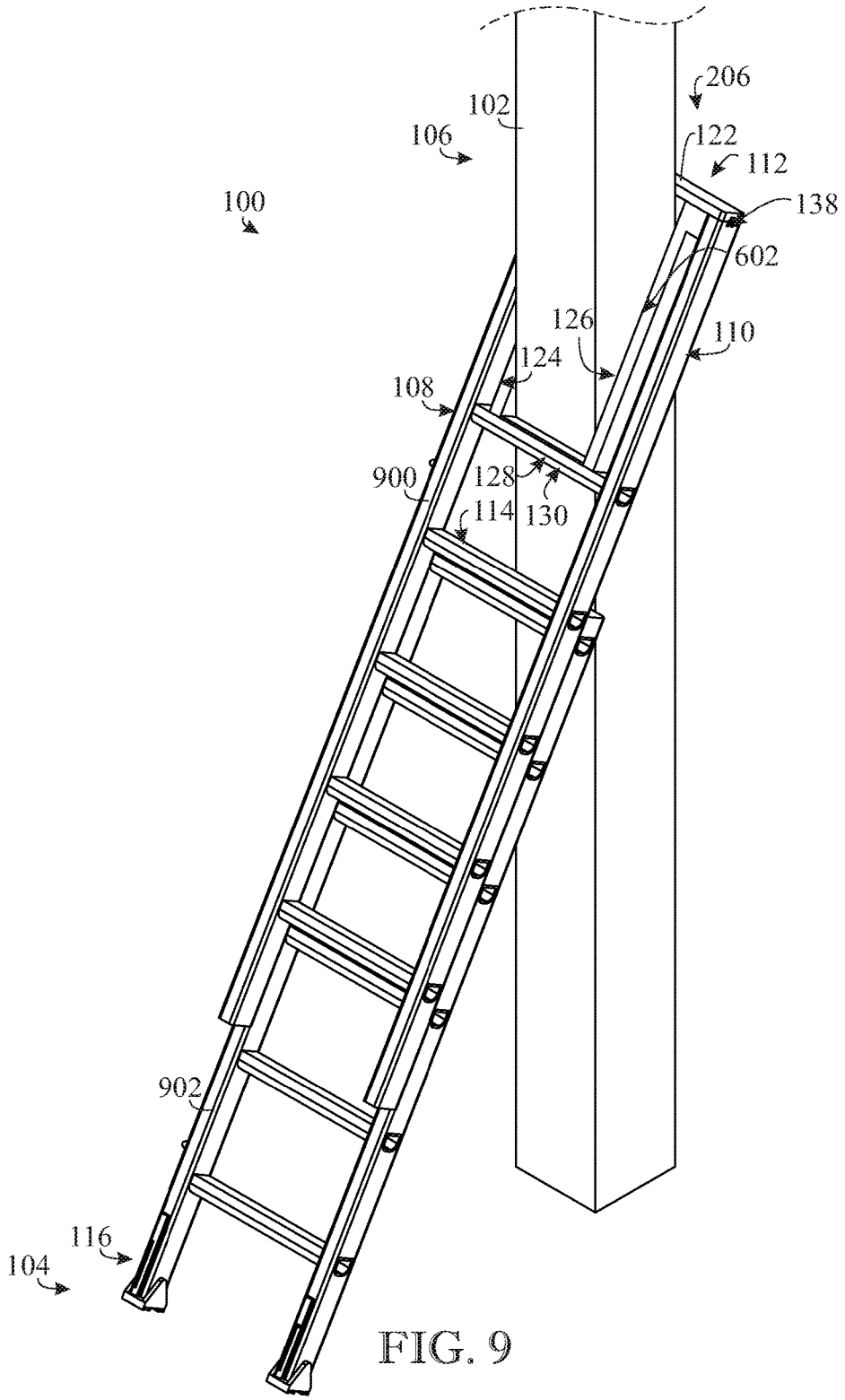
FIG. 9 presents a top right perspective view of the ladder assembly, where the ladder assembly includes an extension, in accordance with aspects of the present disclosure.

Further, the anchor 116 may include a base 120, where the base is configured to pivot about a base axis 504. For example, the base 120 may pivot such that the base 120 remains flat on the proximal surface 402 while the lateral sides 108 and 110 pivot with respect to the proximal surface 402. The base 120 may be selectively pivoted to certain angles relative to the lateral sides 108 and 110 and locked at a desired angle. As shown in FIG. 9, when the base is un-pivoted with respect to the lateral sides 108 and 110, a proximal end of the pin 118 (which extends outward from the ladder assembly) may rest on a top surface of the base 120. When the base is pivoted (e.g. in FIG. 5), the pin 118 may be selectively pushed into the proximal surface 402 as pivoting the base 120 unobstructs the pin 118 from being extended. Therefore, in an unpivoted configuration, the base 120 may obstruct the pin 118 from being extended, and in a pivoted configuration, the base 120 may unobstruct the pin 118 from being extended.

The narrow surface receiver 112 may include an arm 122. The arm 122 may be configured for being selectively opened to an open configuration 204 (FIGS. 2 and 3) for receiving the narrow surface 102 in the narrow surface receiver 112. Further, the arm 122 may be configured for being selectively closed to a closed configuration 206 (FIG. 4) to secure the narrow surface 102 in the narrow surface receiver 112. As a non-limiting example, the arm 122 may be contoured to match a curvature or shape of the narrow surface (e.g. cylindrical or square). The arm 122 may extend between lateral sides 108 and 110 at the distal end 106. The arm 122 may be pivotably attached to second lateral side 110, and in the closed configuration 206 the arm 122 may rest atop, clip on to, or secure to an opposite first lateral side 108.

The narrow surface receiver 112 may include opposing walls 124 and 126 for receiving the narrow surface 102 between the walls 124 and 126. The walls 124 and 126 may extend upward from a top step 128, and generally or directly connect to distal ends of the lateral sides 108 and 110. For example, the walls 124 and 126 may each be connected to a middle portion 130 of the top step 128, somewhere between lateral sides 108 and 110, and connected directly to the lateral sides at the distal end 106, causing the opposing walls 124 and 126 to have a V-like configuration. The opposing walls 124 and 126 may be internal surfaces of two structures that extend from the top step 128 to the distal end 106 of the lateral sides 108 and 110 respectfully. It is to be understood that the walls 124 and 126 may connect to portions of the lateral sides 108 and 110, respectively, that are between top step 128 and distal end 106 of the lateral sides, such that the distal ends 106 of the lateral sides 108 and 110 extend beyond where the walls 124 and 126 connect to the lateral sides 108 and 110.

Figure 2:
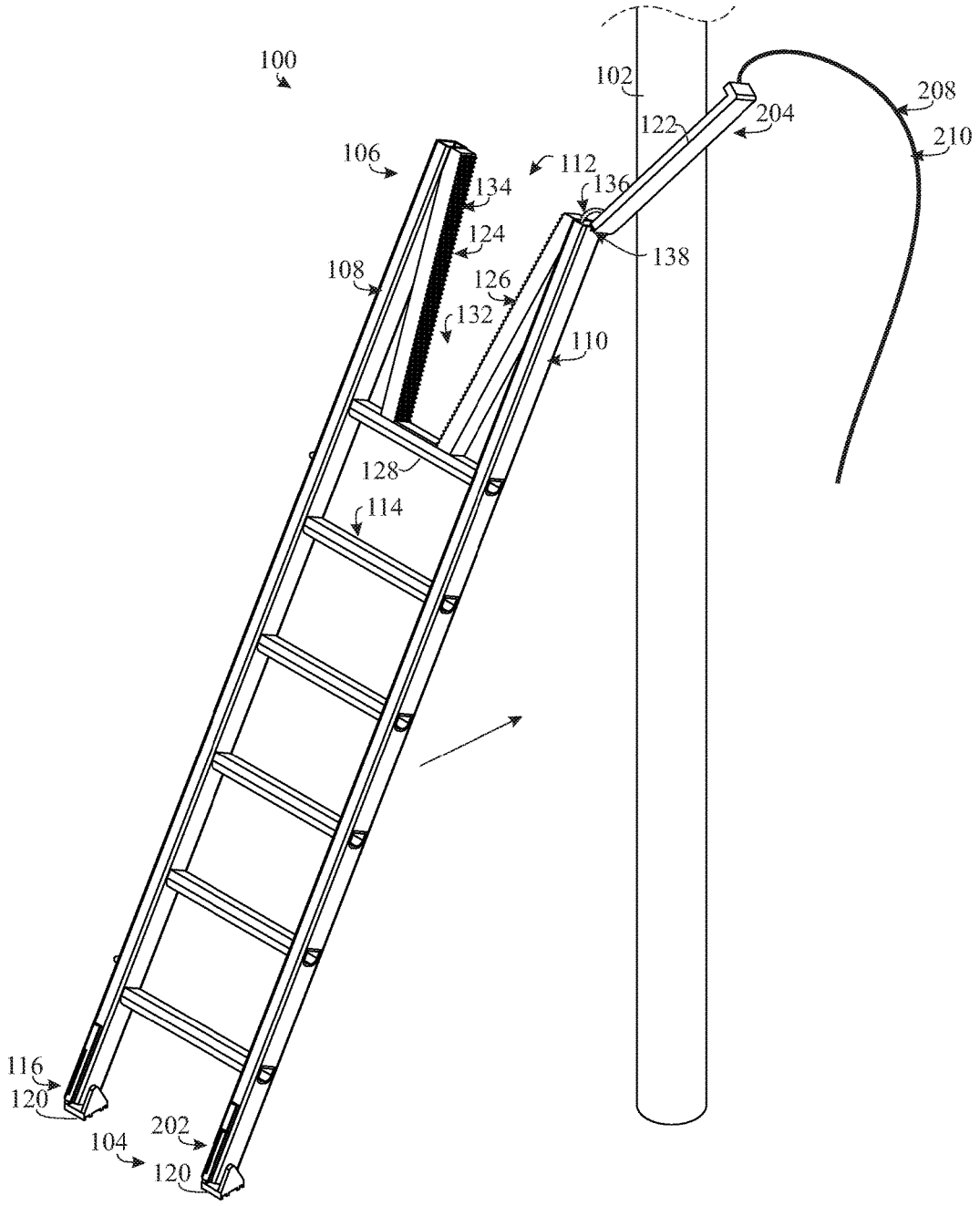
FIG. 2 presents a top right perspective view of a receiving structure of the ladder assembly about to receive a narrow surface, in accordance with aspects of the present disclosure.

A distance "d" (FIG. 1) between the opposing walls 124 and 126 may be decreasingly tapered toward the proximal end 104. For example, FIG. 2 shows distance "d" decreasing from the distal end 106 toward the proximal end 104, such that a space 132 between the opposing walls 124 and 126 is tapered (FIGS. 1-4). This tapered space 132 allows various sizes of narrow surfaces 102 (e.g. having various circumferences, diameters, thicknesses, or shapes) to contact both of the opposing walls 124 and 126 while the ladder assembly 100 leans against such narrow surfaces 102. For example, when the ladder assembly 100 is leaned up against a thinner narrow surface, the thinner narrow surface may end up contacting the opposing walls 124 and 126 more toward the proximal end 104, but a thicker narrow surface may end up contacting the opposing walls 124 and 126 more toward the distal end 106. As shown in FIG. 4, closing the arm around the narrow surface 102 may cause the narrow surface 102 to be surrounded by the opposing walls 124 and 126, the arm 122, and the top step 128. The narrow surface receiver 112 may include a plurality of teeth 134 (FIGS. 1 and 2) on the opposing walls 124 and 126 to maximize frictional force between the narrow surface receiver 112 and a received narrow surface 102. The opposing walls 124 and 126 may include any appropriate inwardly facing texture, material, or configuration to increase frictional force applied to a received narrow surface 102, such as rubber or a gritted surface.

Figure 6:
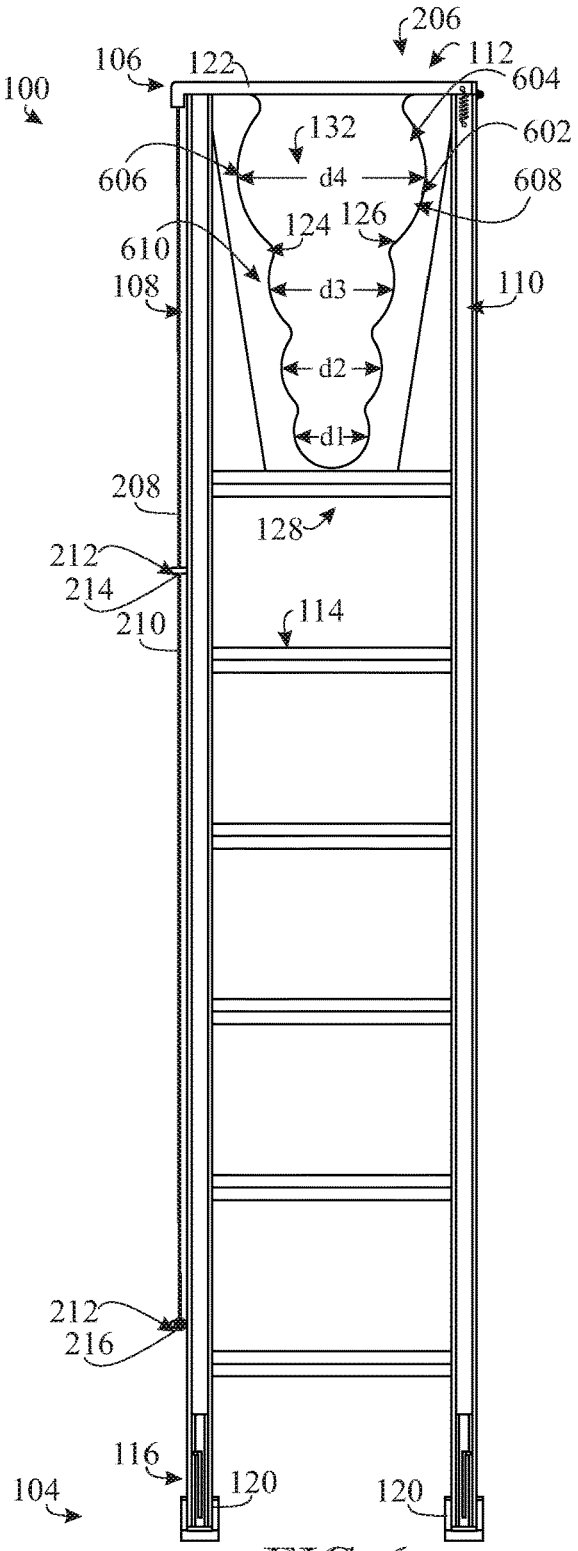
FIG. 6 presents a front view of the ladder assembly, where the receiving structure includes contoured surfaces, in accordance with aspects of the present disclosure.
Figure 7:
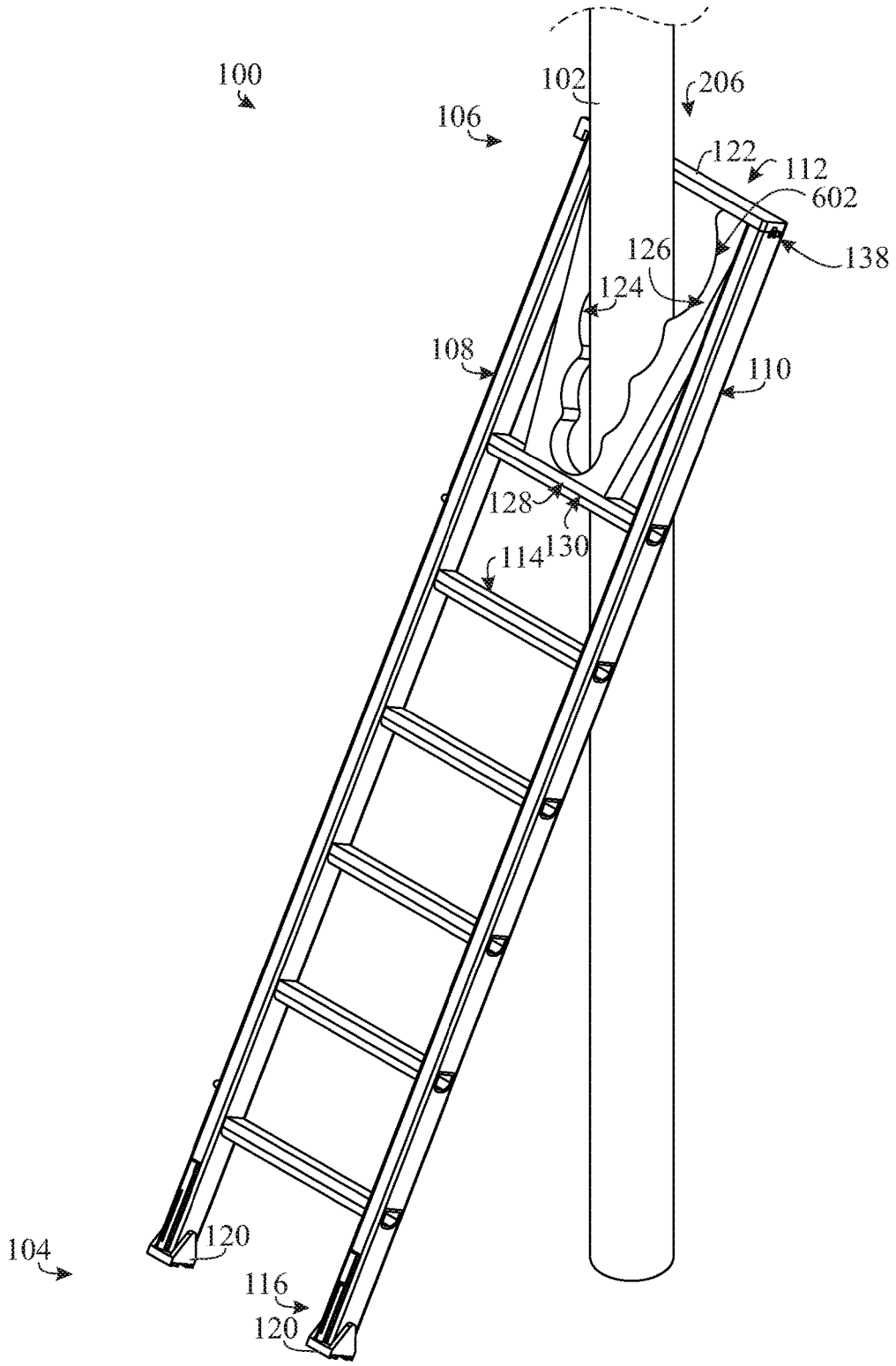
FIG. 7 presents a top right perspective view where the contoured surfaces are receiving a pole, in accordance with aspects of the present disclosure.
Figure 8:
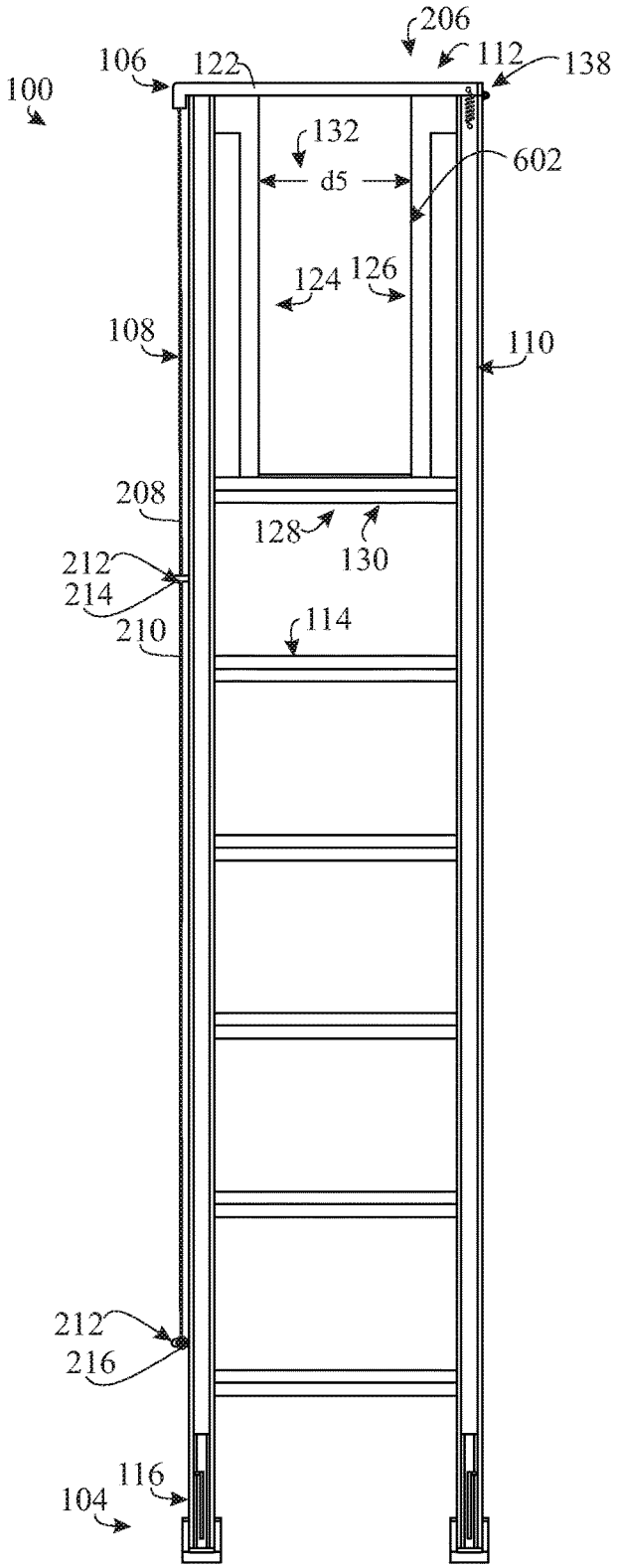
FIG. 8 presents a front view of the ladder assembly where the receiving structure includes right-angled contours, in accordance with aspects of the present disclosure.

As shown in FIGS. 6-9, the narrow surface receiver 112 may include a contoured surface 602. For example, the contoured surface 602 may be configured to at least somewhat contour or conform to a received narrow surface 102. In the example shown in FIG. 6, the contoured surface 602 includes various (increasing or decreasing) diameters of curvature (d4, d3, d2, and d1) to receive various diameters of cylindrical surfaces. In FIG. 8, the contoured surface 602 has a rectangular, square, or right-angled configuration to receive right-angled narrow surfaces as shown in FIG. 9. For example, a right-angled contoured surface may form a right-angled U shape. Therefore, the space 132 may be rectangular or right angled as shown in FIG. 8.

With respect to FIGS. 6 and 7, opposing walls 124 and 126 may each include various curves or sets of curves. For example, opposing walls 124 and 126 may include a first set of curves 604 (FIG. 6) having a first curve 606 on opposing wall 124 that matches a curvature of an opposite second curve 608 located on opposing wall 126, where apexes of the first set of curves 604 face outward toward the lateral sides 108 and 110, and where the apexes are aligned laterally. Similarly, a second set of curves 610 may have the same arrangement but while having a smaller radius or diameter of curvature. Any appropriate number of diameters of curvature, or sets of curves (e.g. a series of sets of curves such as sets 604 and 610) may be included in a single ladder assembly 100. For example, in FIG. 6, four different diameters of curvature and/or sets of curves are included as contoured surfaces. Therefore a thicker cylindrical surface may fit snugly into d4, where a thinner cylindrical surface may fit snugly into d1. With respect to FIGS. 8 and 9, the opposing walls 124 and 126 may be parallel with respect to each other and distanced by distance d5.

Such contours stabilize the ladder assembly 100 while the ladder assembly leans against narrow surfaces. In some embodiments the opposing walls 124 and 126 may be adjustable with respect to one another.

The arm 122 may be spring biased to at least one of the open configuration 204 and the closed configuration 206. For example, being spring biased to the open configuration 204, the arm may be conveniently biased open while a user positions the narrow surface 102 in the narrow surface receiver 112, before closing the arm 122 around the narrow surface 102 or narrow structure. For example, a user may pick up the lateral sides 108 and 110 with both hands to position the ladder assembly 100. Alternatively, the arm 122 may be spring biased to the closed configuration 206 such that a user may release the arm 122 from the open configuration 204 to conveniently close the arm. Therefore, the spring bias may aid a user in opening and closing the arm 122, or for allowing the arm 122 to close or open without the user applying a force to the arm 122.

The spring bias may be applied via a spring 136, as shown in FIGS. 1 and 2. For example, the spring may be attached to the ladder assembly 100 at any appropriate portion, and to the arm 122 to bias the arm. In the example of FIG. the spring 136 is attached to second lateral side 110 at a distal end 106 of the ladder assembly 100, and to the arm 122, near a hinge 138 of the arm 122. For example, the hinge 138 may hingeably attach the arm 122 to second lateral side 110 at distal end 106, and the spring may be attached to the left or right of the hinge 138 depending on which lateral side 108 or 110 the hinge 138 is located. It is to be understood that any appropriate spring mechanism may be included to bias the arm 122, such a torsion spring system inside or surrounding hinge 138.

Figure 3:
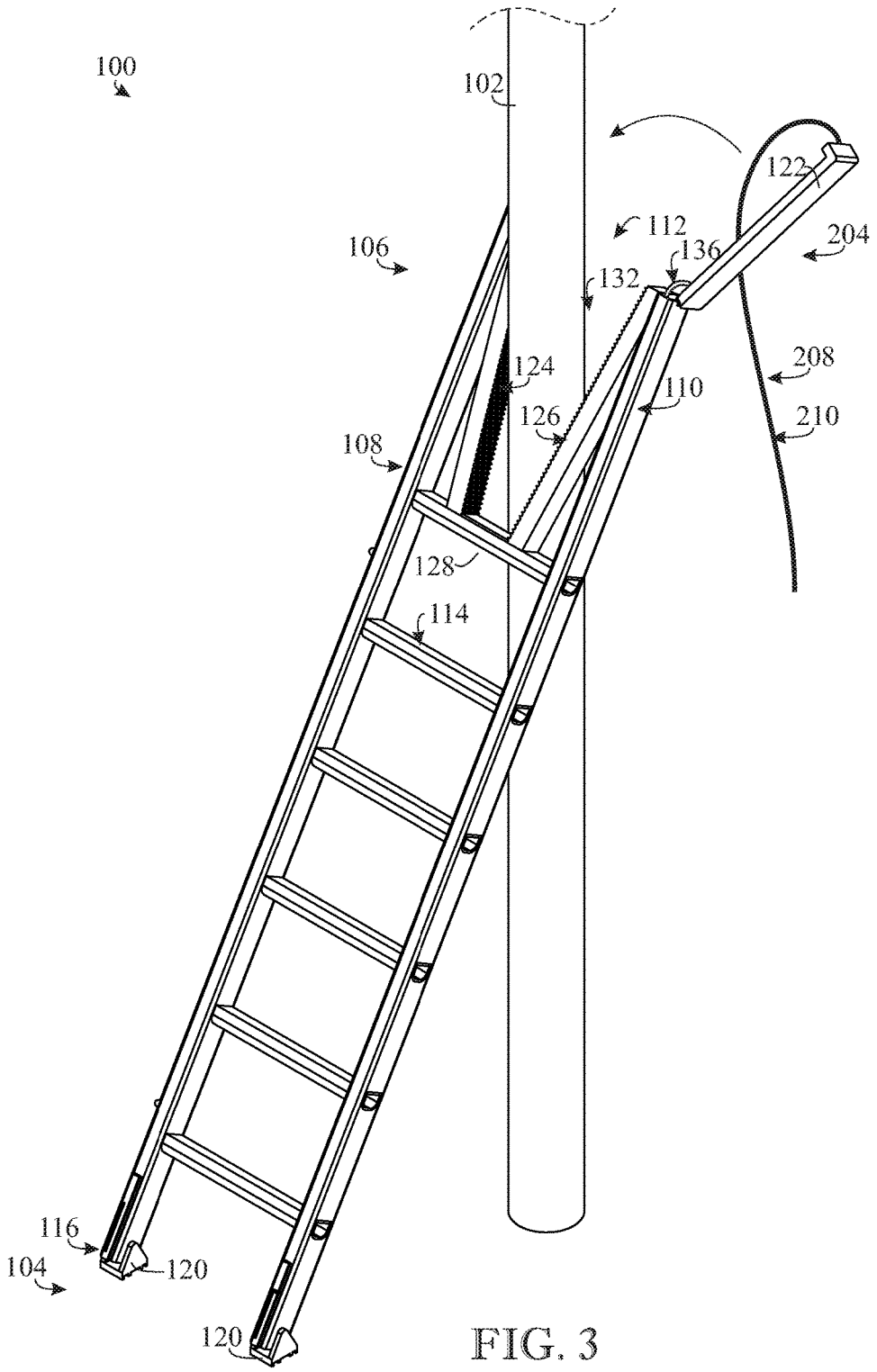
FIG. 3 presents a top right perspective view of the receiving structure having received the narrow surface, and an arm of the receiving structure being operated toward a closed configuration, in accordance with aspects of the present disclosure.
Figure 4:
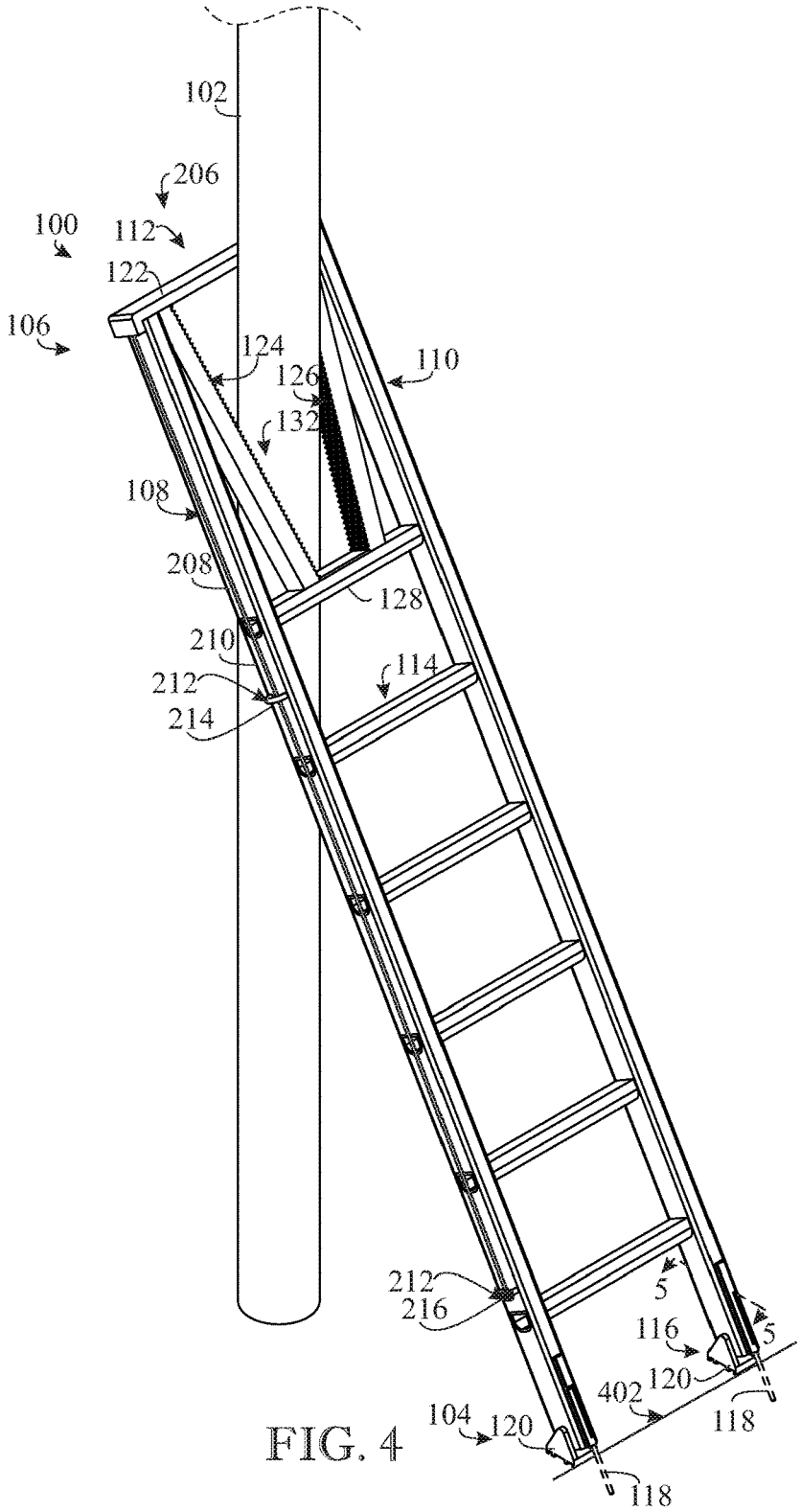
FIG. 4 presents a top left perspective view of the receiving structure having received the narrow surface, and an anchor being operated to secure the ladder assembly to a proximal surface on which the ladder assembly rests, in accordance with aspects of the present disclosure.

The assembly 100 may include a controller 208 to selectively open and close the arm 122 (FIG. 3). For example, the controller 208 may include a string 210 that is long enough to be operated by a user standing on the proximal surface 402. As shown in the string 210 may be pulled to open and close the arm 122. Alternatively, the controller 208 may be a rigid rod that is pivotably attached to the arm 122 for opening (raising) or closing (lowering) the arm 122. The controller 208 may be attached to an opposite side of the arm (or generally in an opposite direction) with respect to a location of the hinge 138. For example, if the hinge 138 is at a right side of the arm 122, the controller may be attached to the left side of the arm 122. However, the controller 208 may be attached to any appropriate portion of the arm 122. It is anticipated that the controller 208 may be, or may include, an electronic system and/or motors that are operable by a user to open and close the arm.

As shown FIG. 4, the assembly may include one or more securers 212 for securing the controller 208 (e.g. string) to the assembly 100. For example, the securers 212 may be rings or eyes that are configured to receive the string 210 through the securers 212. As shown in FIG. 4, the string 210 is taught and threaded through a first securer 214 and tied to a second securer 216 thus keeping the arm 122 closed. In another example, the securers may be or include clips or clamps for securing the controller 208.

Figure 10:
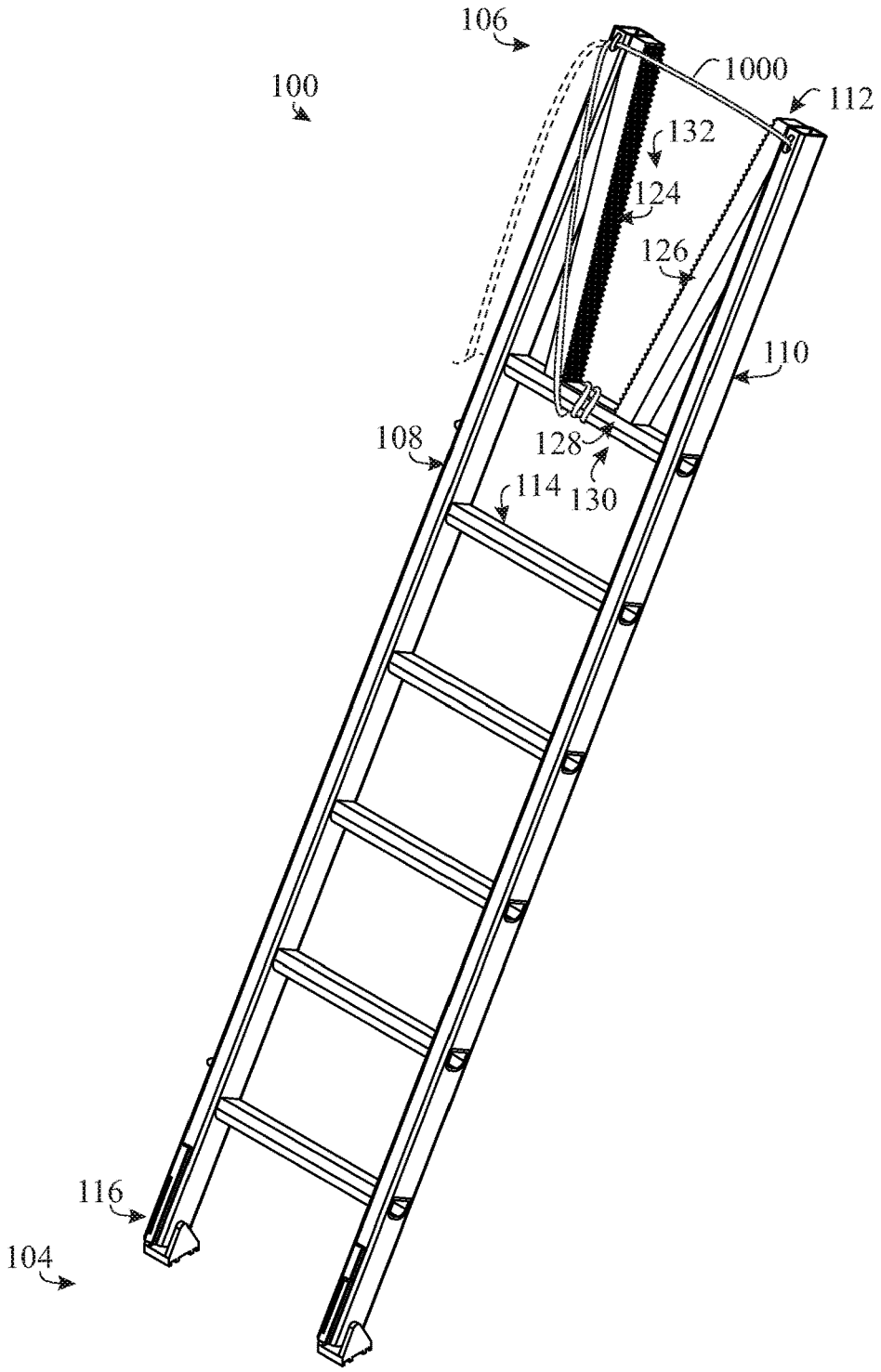
FIG. 10 presents a top right perspective view of the ladder assembly, where the receiving structure includes a strap, in accordance with aspects of the present disclosure.

In the example of FIG. 10, the narrow surface receiver 112 may include a strap 1000 for strapping the narrow surface receiver 112 to a narrow surface 102. The strap 1000 may be a string or rope that may function similarly to the arm 122 as described above. The strap may extend from one lateral side (e.g. 110) to an opposite lateral side (e.g. 108) at the distal end 106. The strap 1000 may be tied to one or more of the steps 114 as shown in FIG. 10.

As shown in FIG. 9, the ladder assembly 100 may include an extension 900. The extension 900 may include the narrow surface receiver 112 at a distal end of the extension. The extension 900 may be slidably attached to a lower portion 902, where the lower portion includes the anchor 116, and the extension 900 distally extends from the lower portion to variable heights.

In conclusion, the disclosed ladder assembly provides improved stability and convenience for climbing narrow structures and surfaces such as trees or poles.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ladder assembly configured for being supported on narrow surfaces, the assembly comprising:

a proximal end and a distal end;

a first lateral side and a second lateral side, the lateral sides being between the proximal end and the distal end, the lateral sides;

at the distal end, a narrow surface receiver, the narrow surface receiver being configured to receive a narrow surface somewhere between the lateral sides;

an anchor at the proximal end, the anchor being configured to aid in securing the proximal end to a proximal surface, wherein the narrow surface receiver includes a first opposing wall and a second opposing wall for receiving the narrow surface between the walls, where a distance between the opposing walls is decreasingly tapered toward the proximal end;

wherein the narrow surface includes one or more teeth to maximize frictional force between the narrow surface receiver and a received narrow surface;

wherein the narrow surface is a portion of a vertical object;

wherein the narrow surface receiver includes an arm, the arm configured for being selectively opened to an open configuration for receiving the narrow surface;

wherein the arm is spring biased to at least one of an open and closed configuration;

a controller to selectively open and close the arm; and wherein the controller includes a string that is long enough to be operated by a user standing on the proximal surface;

one or more string securers for securing the string to the assembly; and an extension, the extension including the narrow surface receiver at a distal end of the extension, the extension being slidably attached to a lower portion of the ladder assembly, the lower portion including the anchor, and the extension distally extending from the lower portion to variable heights;

a top step, the first opposing wall attached to the top step and the first lateral side and extending between the top step and the first lateral side, and the second opposing wall attached to the top step and the second lateral side and extending between the top step and the second lateral side; and wherein the anchor includes a pivoting base, the pivoting base configured to remain flat on the proximal surface while the lateral sides pivot with respect to the proximal surface, and the pivoting base being configured to selectively pivot to various angles relative to the lateral sides; and wherein the anchor includes a pin which is configured to selectively extend outward from the anchor, a proximal end of the pin being configured to rest on top of the pivoting base when the base is in an un-pivoted position with respect to the lateral sides;

wherein when the base is un-pivoted, an extension action of the pin is obstructed by the base, and the base is configured such that when the base is pivoted to a sufficient angle relative to the lateral sides, the extension action of the pin is unobstructed; and wherein pivoting the base to the sufficient angle relative to the lateral sides releases the pin from being obstructed by the pivoting base to permit the pin to be extended into the proximal surface.

* * * * *